United States Patent [19]

Sugimoto

[11] Patent Number: 4,722,676

[45] Date of Patent: Feb. 2, 1988

[54] AXIAL SEALING MECHANISM FOR SCROLL TYPE FLUID DISPLACEMENT APPARATUS

[75] Inventor: Kazuo Sugimoto, Isesaki, Japan

[73] Assignee: Sanden Corporation, Isesaki, Japan

[21] Appl. No.: 922,458

[22] Filed: Oct. 23, 1986

[30] Foreign Application Priority Data

Oct. 25, 1985 [JP] Japan ..... 60-163024[U]

[51] Int. Cl.[4] ..... F01C 1/04; F01C 19/08

[52] U.S. Cl. ..... 418/55; 418/83; 418/142; 277/26; 277/204

[58] Field of Search ..... 418/55, 83, 142; 277/26, 204

[56] References Cited

U.S. PATENT DOCUMENTS 3,994,636 11/1976 McCullough et al. ..... 418/142

4,472,120 9/1984 McCullough ..... 418/83

FOREIGN PATENT DOCUMENTS 65261 11/1982 European Pat. Off. ..... 418/55

59-176483 10/1984 Japan ..... 418/83

*Primary Examiner*—John J. Vrablik

*Attorney, Agent, or Firm*—Banner, Birch, McKie & Beckett

[57] ABSTRACT

A scroll type fluid displacement apparatus with an axial sealing mechanism is disclosed. The compressor includes a pair of scrolls each of which comprises an end plate and a spiral element extending axially from one end surface of the end plate. A groove of uniform depth is formed in the axial end surface of each spiral element and a seal element is disposed within each of the grooves to seal the fluid pockets defined by the scrolls. The axial thickness of the seal element at the center thereof is smaller than the depth of the groove and the axial thickness of the seal element at the outer portion thereof is larger than the depth of the groove. Accordingly, when the compressor is assembled, an axial gap between both scrolls is fixed by the seal element, and the devices can accommodate thermal expansion of the spiral element because of the temperature rise in the fluid upon compression.

4 Claims, 5 Drawing Figures

AXIAL SEALING MECHANISM FOR SCROLL TYPE FLUID DISPLACEMENT APPARATUS

TECHNICAL FIELD

The present invention relates to a scroll type fluid displacement apparatus, and more particularly, to an improved axial seal for the compression chambers or fluid pockets in a scroll type fluid displacement apparatus.

BACKGROUND OF THE INVENTION

Scroll type fluid displacement apparatus are well known in the prior art. For example, U.S. Pat. No. 801,182 discloses a scroll type apparatus including two scroll mechanisms each having an end plate and spiroidal or involute spiral element. The scroll members are angularly and radially offset so that both spiral elements interfit to make a plurality of line contacts between the spiral surfaces, thereby sealing off and defining at least one pair of fluid pockets. The relative orbital motion of the two scroll members shifts the line contact along the spiral surfaces to change the volume of the fluid pockets relative to the fluid outlet. The volume of the fluid pockets increases or decreases depending on the direction of the orbiting motion. A scroll type fluid displacement apparatus of this nature can be used to compress, expand or pump fluids.

In this type of fluid displacement apparatus, effective sealing of the fluid pockets is required. That is, axial and radial sealing of the fluid pockets must be maintained in order to achieve effective operation—the radial sealing being the line contact between the two interfitting spiral elements and the axial seal being the contact between the axial end surface of the spiral element and the inner end surface of the opposed end plate.

Various techniques have been used in the prior art to resolve the sealing problem, particularly, the axial sealing problem. For example, U.S. Pat. No. 3,994,636 discloses a technique for mounting a seal element in a groove in the free end of the spiral so that it can move freely. The seal element may be urged toward the opposed end plate by the resiliency of spring elements placed in the groove or by fluid pressure introduced into the groove from the fluid pockets. In this type of axial sealing, normally, the axial gap between the outer end surface of the spiral element and the inner surface of the opposed end plate is determined with respect to sealing the fluid pocket and the durability of seal element and the scroll. However, with a seal element loosely fitted within the groove, maintaing the axial gap is difficult because of the thermal expansion of the spiral element.

A further technique to resolve the axial sealing problem is disclosed in our earlier application Ser. No. 376,959 filed on May 11, 1982 now abandoned. In this prior device, the axial thickness of the seal element is greater than the depth of the groove and the seal element therefore extends between the bottom of the groove and the opposed end plate. However, in this type of sealing mechanism, the dimensions of the seal elements and the scrolls required a high degree of precision in establishing the axial gap. Thus, manufacturing of the scroll is complicated and relatively expensive.

Furthermore, even if the axial gap is correctly determined during the assembly of the compressor, the actual axial gap varies in operation because of the temperature change in the fluid as it is comprised, i.e., the temperature of the fluid at the center or fluid outlet portion of the scroll is higher than the temperature at the outer or fluid inlet portion of the scroll. The rate of thermal expansion of the spiral elements varies and, with a uniform axial gap, increased frictional contact between the end plate and spiral element would occur in the center of spiral element.

SUMMARY OF THE INVENTION

It is a primary object of this invention to provide a scroll type fluid displacement apparatus in which, during assembly, an axial gap between both scrolls and the face of the plates can be easily set.

It is another object of this invention to provide a scroll type fluid displacement apparatus with improved durability.

A scroll type fluid displacement apparatus according to the present invention includes a pair of scrolls each of which comprises an end plate and a spiral element which extends from one end surface of the end plate. Both spiral elements interfit and are angularly and radially offset to make a plurality of line contacts to define at least one pair of sealed fluid pockets. Drive means are operatively connected to one of the scrolls to cause it to undergo orbital motion relative to the other scroll and means are provided to restrain it against rotation. The fluid pockets change volume relative to the outlet upon the orbital motion of the one scroll and thus act to compress the entrapped fluid. Each of the scroll is provided with a groove on the axial end surface of the spiral element and a seal element disposed within the groove and urged into contact with the adjacent end plate by the varying fluid pressure. The seal element has an axial thickness less than the depth of the groove at the center or fluid outlet of the scroll and an axial thickness greater than the depth of the groove at an outer portion or fluid inlet thereof to accommodate expansion due to the increased temperature of the fluid upon compression.

Further objects, features and aspects of this invention will be understood from the following detailed description of a preferred embodiments of this invention, referring to the annexed drawings.

BRIEF DESCRIPTION OF THE DRAWINGS

FIG. 4(*b*) is an enlarged cross-sectional view of the outer portion of the scroll member shown in FIG. 2 or 3.

DETAILED DESCRIPTION OF THE PREFERRED EMBODIMENTS

Figure 1:
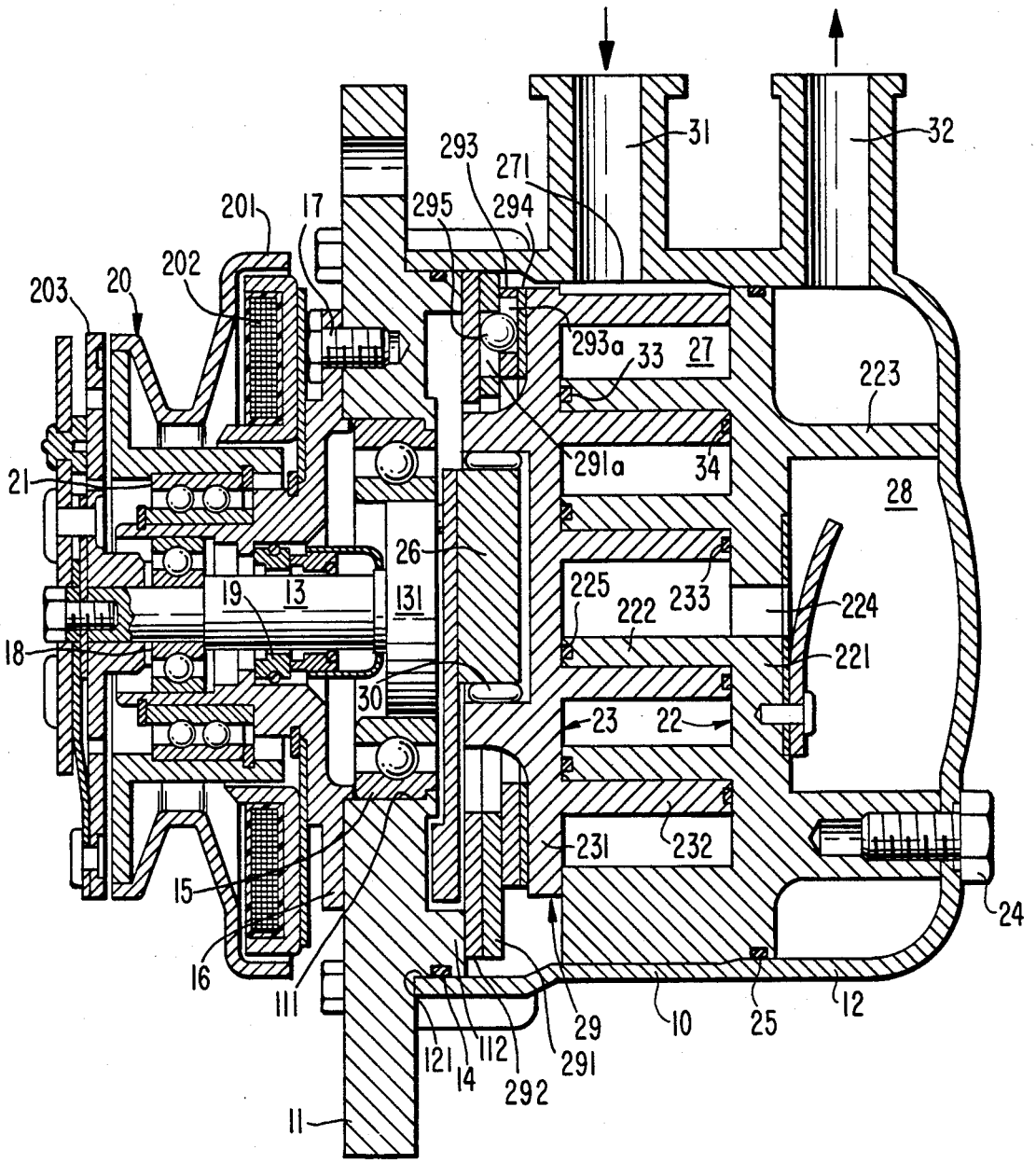
FIG. 1 is a cross-sectional view of a scroll type compressor in accordance with one embodiment of this invention.

With reference to FIG. 1, there is shown a scroll type compressor in accordance with one embodiment of the present invention. The scroll type compressor includes compressor housing 10 having a front end plate 11 and a cup-shaped casing 12 to an end surface of which the front end plate 11 is attached. An opening 111 at the center of the front end plate 11 receives a drive shaft 13 and an annular projection 112 is formed on the rear surface of front end plate 11 concentric with opening 111 and facing into the cup-shaped casing 12. The projection 112 extends into the open end 121 of the cup-shaped casing 12 with the front end plate 11 closing the open end thereof. An O-ring 14 is placed between the outer peripheral surface of annular projection 112 and the inner wall of the open end 121 of the cup-shaped casing 12 to form a seal between them.

Annular sleeve 16 projects from the front surface of front end plate 11 to surround drive shaft 13 and define a shaft seal cavity. Sleeve 16 is formed separately from front end plate 11 and is fixed thereto such as by screw 17 but could of course be integral with front end plate 11.

Drive shaft 13 is rotatably supported by sleeve 16 through bearing 18 mounted within the front end of sleeve 16. Drive shaft 13 has a crank disc 131 at its inner end which is rotatably supported by front end plate 11 through bearing 15 located within opening 111 of front end plate 11. Shaft seal assembly 19 is coupled to drive shaft 13 within the shaft seal cavity of sleeve 16.

Pulley 201 is rotatably supported by ball bearing 21 which is carried on the outer surface of sleeve 16. Electromagnetic coil 202 is fixed about the outer surface of sleeve 16 by a support plate. Armature plate 203 is resiliently supported on the outer end of drive shaft 13. Pulley 201, magnetic coil 202 and armature plate 203 form a magnetic clutch 20. In operation, drive shaft 13 is driven by an external power source, for example, the engine of an automobile, through a rotation transmitting device such as the above explained magnetic clutch.

Fixed scroll 22, orbiting scroll 23, a driving mechanism for orbiting scroll 23 and a rotation preventing/-thrust bearing mechanism for orbiting scroll 23 are disposed in the interior of housing 10.

The fixed scroll 22 includes a circular end plate 221 and a spiral element 222 affixed to or extending from one end surface thereof. Circular end plate 221 of fixed scroll 22 partitions the inner chamber of cup-shaped casing 12 into two chambers, that is, the front chamber 27 and the rear chamber 28 with the spiral element 222 located in front chamber 27.

An annular wall 223 projects axially from the rear end surface of circular end plate 221 with the end thereof in contact with the inner surface of cup-shaped casing 12 and fixed thereto by a plurality of bolts 24 (only one of which is shown in FIG. 1). An O-ring 25 may be disposed between the periphery of the circular end plate 221 and the inner surface of cup-shaped portion to form a seal.

Orbiting scroll 23, which is also located in the front chamber 27, includes a spiral element 232 affixed to or extending from one surface of circular end plate 231. In the usual manner, the spiral elements 232 and 222 are interfitted and angularly and radially offset. Orbiting scroll 23 is actuated by an eccentric bushing 26 that is mounted on the inner end of the crank disc 131 eccentrically relative to the axis of drive shaft 13, the bushing 26 is seated in a circular recess in the face of the orbiting scroll 23 and is rotatable relative thereto through radial needle bearing 30.

The orbiting scroll 23 is held against rotation by a rotation preventing/thrust bearing mechanism 29 which is placed between the inner end surface of front end plate 11 and circular end plate 231 of orbiting scroll 23. Rotation preventing/thrust bearing mechanism 29 includes fixed ring 291, fixed race 292, orbiting ring 293, orbiting race 294 and balls 295. Fixed ring 291 is attached on the inner end surface of front end plate 11 through fixed race 292 and has a plurality of circular holes **291*a*. Orbiting ring 293 is attached on the rear end surface of orbiting scroll 23 through orbiting race 294 and has a plurality of circular holes 293a. Each ball 295 is placed between a hole 291*a* of fixed ring 291 and hole 293*a* of orbiting ring 293, and moves along the edges of both circular holes 291*a* and 293*a*. Also, axial thrust load from orbiting scroll 23 is supported on front end plate 11 through balls 295**.

Compressor housing 10 is provided with inlet port 31 and with an outlet port 32 for connecting the compressor to an external refrigerating circuit. Refrigerating gas from the external circuit is introduced into front chamber 27 through inlet port 31 and is taken into fluid pockets or openings formed between the spiral elements 222 and 232. The fluid pockets or openings sequentially open and close during the orbital motion of orbiting scroll 23. When the fluid pocket or opening is open to the inlet 31, fluid to be compressed is taken in, and when the fluid pocket or opening is closed and no additional fluid can be taken in, compression begins. In the usual manner, refrigerant gas taken in through the inlet 31 is moved radially inward and compressed in accordance with the orbital motion of orbiting scroll 23. Compressed refrigerant gas is discharged to the rear chamber 28 through the discharge port 224 at the center of the circular end plate 221 and through the outlet port 92.

Figure 2:
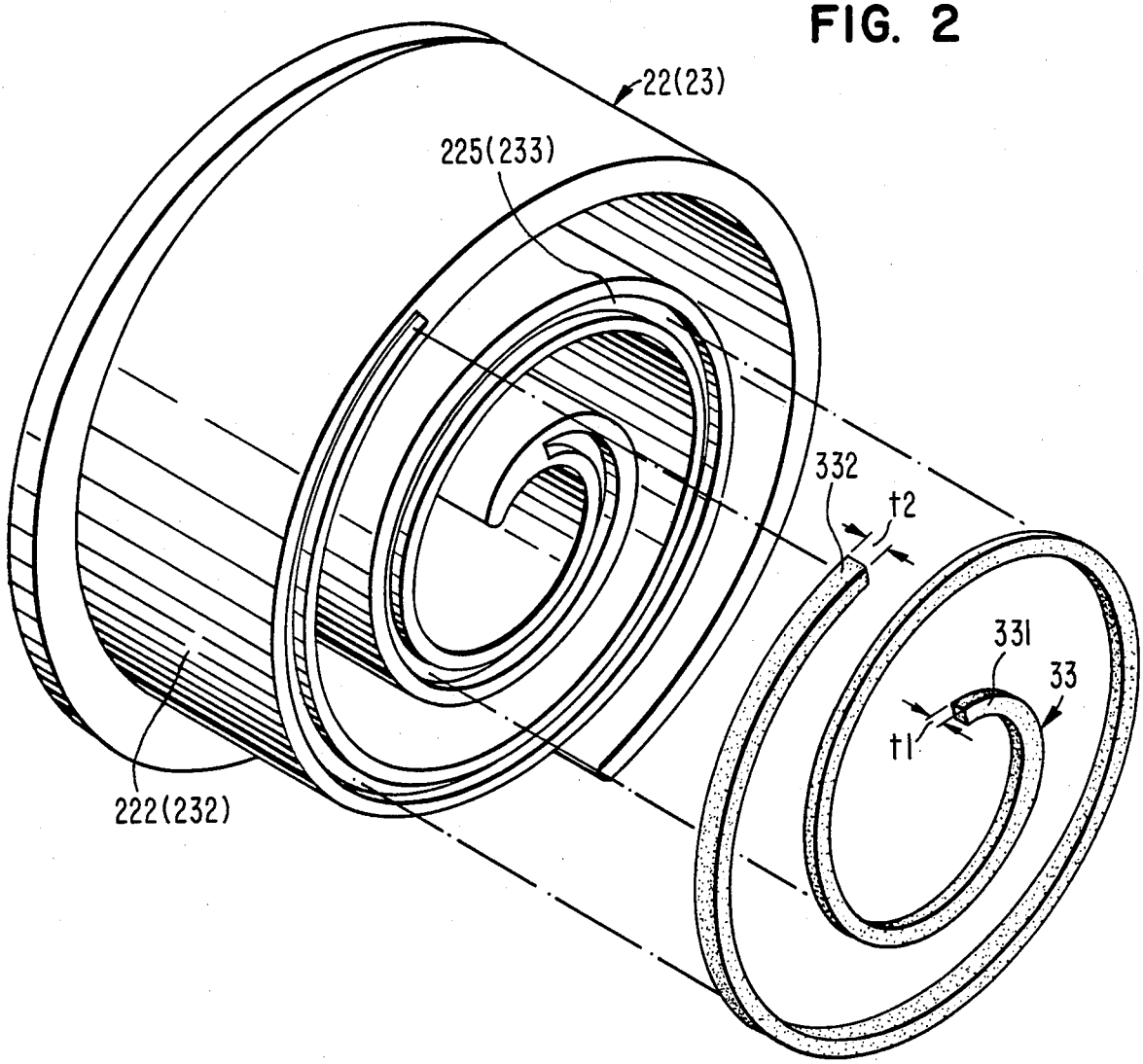
FIG. 2 is a perspective view illustrating the scroll member utilized in the compressor of FIG. 1.
Figure 4A:
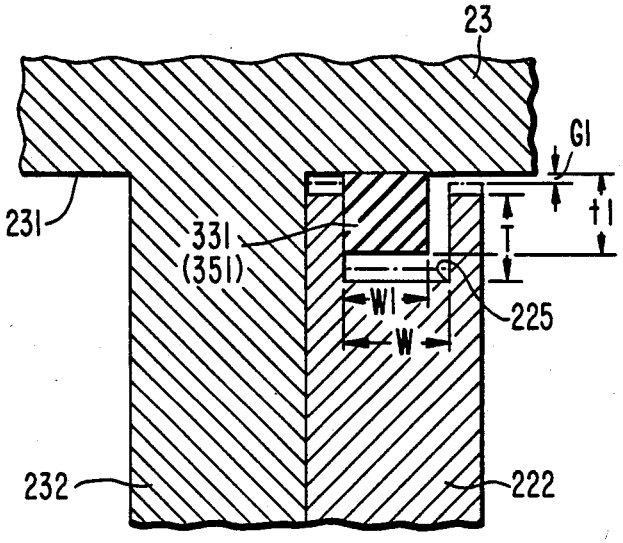
FIG. 4(*a*) is an enlarged cross-sectional view of the central portion of the scroll member shown in FIG. 2 or 3.
Figure 4B:
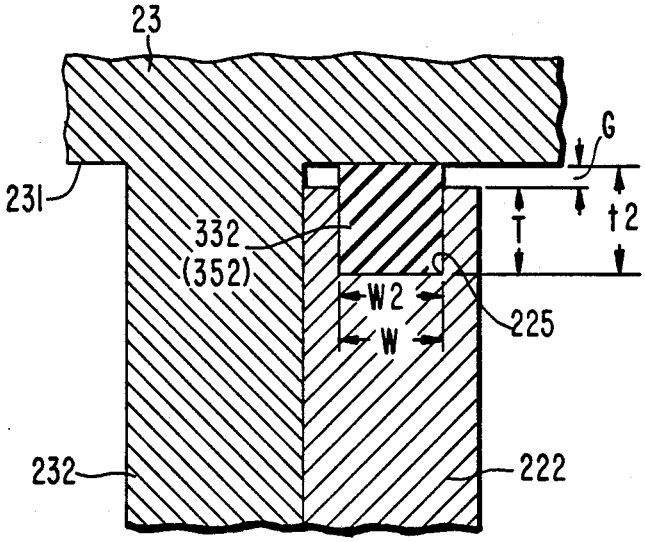

Referring to FIG. 2, each spiral element 222, 232 is provided with a groove 225, 233 formed on its axial end surface along the spiral curve. Grooves 225, 233 extend from the inner end portion of the spiral element to a position close to the terminal end of the spiral element. The depth of the groove 225, 233 is uniform and a seal element 33 is disposed within the groove 225, 233. In this structure, axial thickness t1 of the inner end portion 331 of seal element 33 is smaller than depth T of groove 225, 233, as shown in FIG. 4(*a*) and also, axial thickness t2 of the outer portion 332 of seal element 33 is larger than depth T of groove 225, as shown in FIG. 4(*b*). Also, width w1 of seal element 33 at central portion 331 is smaller than width W of groove 225, and width w2 of seal element 33 at outer portion 332 is equal to width W of groove 225. Therefore, when the scroll elements 22, 23 are assembled during manufacture, only the outer portions 332 of seal elements 33 contact against the opposed circular end plates 221, 231.

Figure 3:
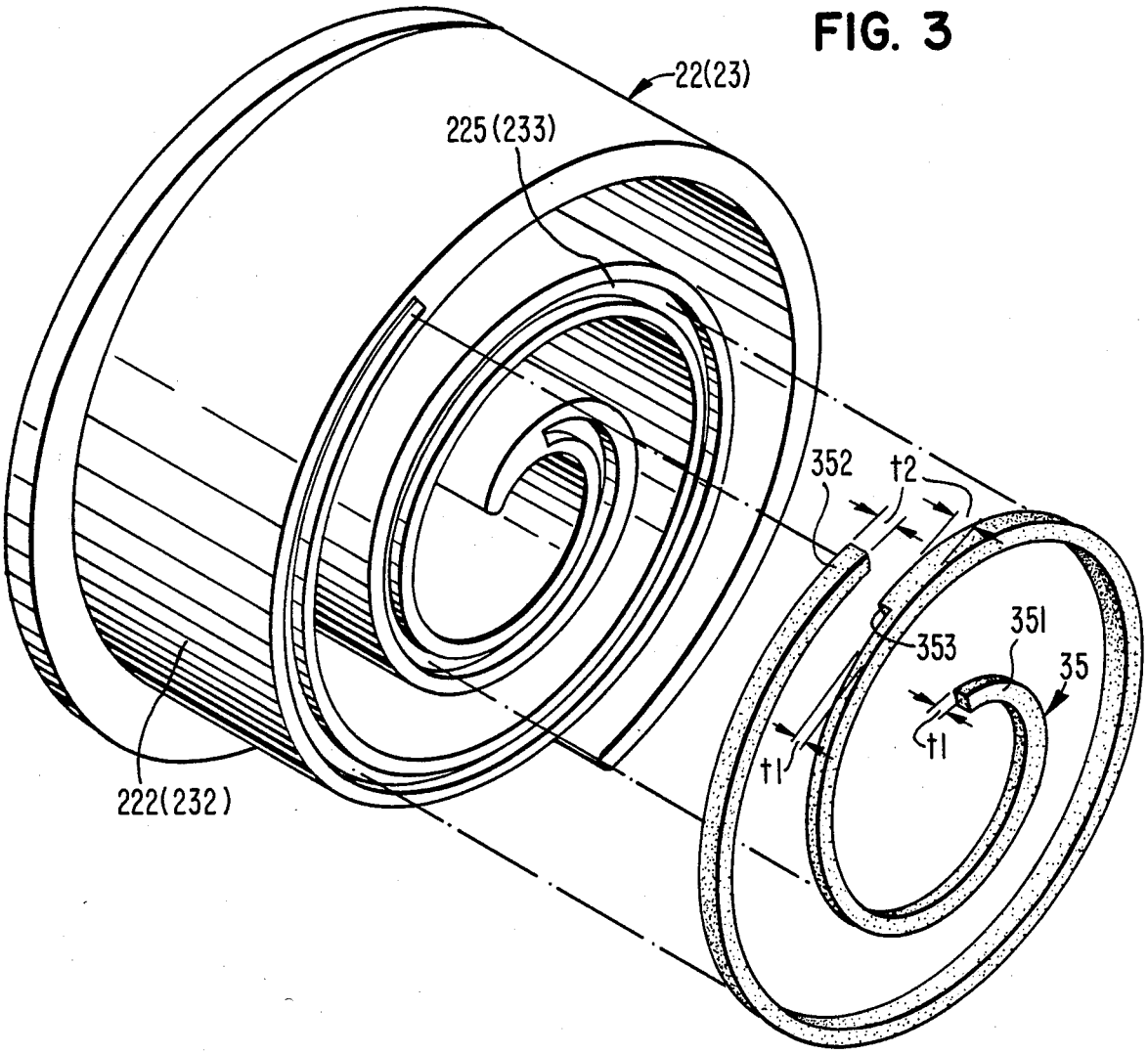
FIG. 3 is a perspective view similar to FIG. 2 of another embodiment.

In the preferred embodiment, the thicker and thinner portions of the seal elements 33 are formed by gradually reducing the axial thickness of the seal element 33 from the outer end 332 to the inner end 331. Alternatively, the thicker and thinner portions of the seal elements may be divided by steps, as shown in FIG. 3, that is, the inner portion 351 of a seal element 35 and the outer portion 352 thereof are divided by step portion 353. The step portion 353 is disposed at one turn of the spiral curve from the inner end 351 of the seal element 35.

Referring again to FIG. 4(*b*), the distance between the axial end surface of the spiral element 222, 232 of one scroll and the opposed surface of circular end plate 221, 231 of the other scroll defines a gap G having a depth equal to 12−T. On the other hand, the center portion 331 of seal elements 33 is capable of axial movement within the range of (t2−t1). The axial thickness t1 of the central portions 331 of the seal elements 33 is selected so as to be larger than axial gap G.

During the operation of the compressor, the central portion 331 of seal element 33 is urged toward a side wall of groove 225, 233 by the pressure difference between the fluid pockets, as shown in FIG. 4(*a*), and is also urged toward opposed circular end plate 221, 231 by fluid pressure introduced into groove 225, 233 from the center of the scroll to effect a seal. The increased temperature at the central portion of the scrolls 22, 23 due to the compression of the fluid causes the central portion of scrolls 22, 23 to expand axially as shown by a dash and dotted line in FIG. 4(*a*). Accordingly, the axial gap between the end surface of spiral element 222, 232 and the circular end plate 221, 231 narrows from G to G1. However, since the axial thickness t1 at the central portion 331 of the seal element 33 is smaller than the depth T of the groove 225, 233, the central portion 331 of the seal element 33 does not engage both the bottom surface of groove 225, 233 and the circular end plate 221, 231 and the frictional resistance between the seal element 33 and the end plate 225, 233 is not increased.

This invention has been described in detail in connection with preferred embodiments, but these are example only and this invention is not restricted thereto. It will be easily understood by those skilled in the art that other variations and modifications can be easily made within the scope of this invention.

I claim:

1. In a scroll type fluid displacement apparatus including a pair of scrolls each comprising an end plate and a spiral element extending from one surface of said end plate and provided with a groove formed in the axial end surface thereof along the spiral curve, both spiral elements interfitting at an angular and radial offset to make a plurality of line contacts to define at least one pair of sealed off fluid pockets, drive means operatively connected to one of said scrolls to cause said one scroll to undergo orbital motion relative to the other scroll, rotation preventing means for said one scroll, whereby said fluid pockets change the volume due to orbital motion of said one scroll, and a seal element disposed within each of said grooves to seal the fluid pockets, the improvement comprising said groove having a uniform depth, the axial thickness of the central portion of said seal element being smaller than the depth of said groove and the axial thickness of the outer portion of said seal element being larger than the depth of said groove.

2. The scroll type fluid displacement apparatus of claim 1 wherein said seal element is formed so that said axial thickness thereof is successively increased from said central portion of said outer portion.

3. The scroll type fluid displacement apparatus of claim 1 wherein said seal element is formed so that axial thickness thereof is increased from said central portion to said outer portion in at least one step.

4. The scroll type fluid displacement apparatus of claim 3 wherein the thinner portion of said seal element extends from the inner end of the scroll for about one turn of the spiral curve.

* * * * *